United States Patent [19]

Gibbs

[11] 4,169,324

[45] Oct. 2, 1979

[54] SOCK AND SHOE AND SOCK AND SHOE FASTENING MEANS

[76] Inventor: Don W. Gibbs, 3452 Monte Verde Dr., Holladay, Utah 84109

[21] Appl. No.: 873,921

[22] Filed: Jan. 31, 1978

[51] Int. Cl.[2] ..... A43B 1/00; A43B 1/04; A41B 11/00

[52] U.S. Cl. ..... 36/83; 36/9 R; 36/10; 2/61; 2/239; 2/240

[58] Field of Search ..... 36/83, 10, 9; 2/DIG. 6, 2/61, 239, 240; 66/171

[56] References Cited

U.S. PATENT DOCUMENTS

| | | | |
|---|---|---|---|
| D. 208,850 | 10/1967 | Thorneburg et al. | D2/330 |
| 527,717 | 10/1894 | Pendergast | 36/9 R |
| 2,238,804 | 4/1941 | Brown | 36/10 |
| 2,422,410 | 6/1947 | Gross | 36/10 |
| 2,623,374 | 12/1952 | Hinchman | 2/239 UX |
| 3,000,013 | 9/1961 | Traenkle | 2/240 |
| 3,099,884 | 8/1963 | Kixmiller et al. | 2/DIG. 6 |
| 3,274,804 | 9/1966 | Thorneburg et al. | 66/171 |
| 3,289,329 | 12/1966 | Weiss | 36/10 |
| 3,315,276 | 4/1967 | Daxe | 2/239 |
| 3,492,674 | 2/1970 | Poole | 2/239 |
| 4,055,858 | 11/1977 | Traenkle | 36/10 |
| 4,058,853 | 11/1977 | Boxer et al. | 2/239 |

FOREIGN PATENT DOCUMENTS

| | | | |
|---|---|---|---|
| 607268 | 12/1934 | Fed. Rep. of Germany | 36/10 |
| 1396798 | 3/1965 | France | 2/240 |

*Primary Examiner*—James Kee Chi

*Attorney, Agent, or Firm*—Criddle, Thorpe & Western

[57] ABSTRACT

The present invention relates to a sock having a flap protruding from its rear or heel area, which flap can be fastened to the outside of the rear or heel area of a shoe to prevent the sock from riding, slipping or otherwise working into the heel cavity of the shoe as the person wearing the sock and shoe moves about.

17 Claims, 6 Drawing Figures

FIG. 1
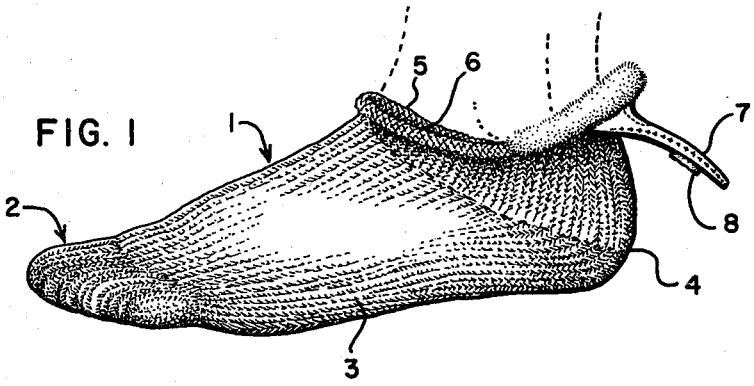
FIG. 2
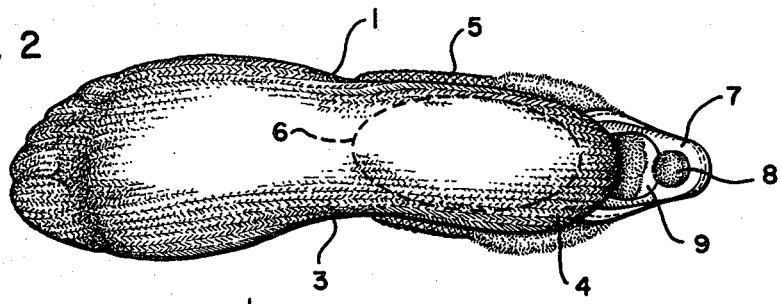
FIG. 3
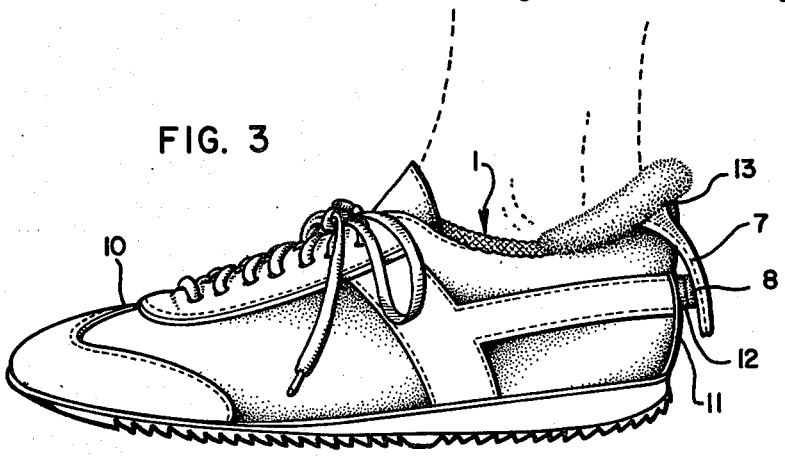
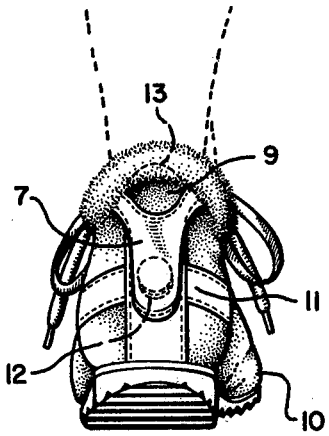
FIG. 4
FIG. 5
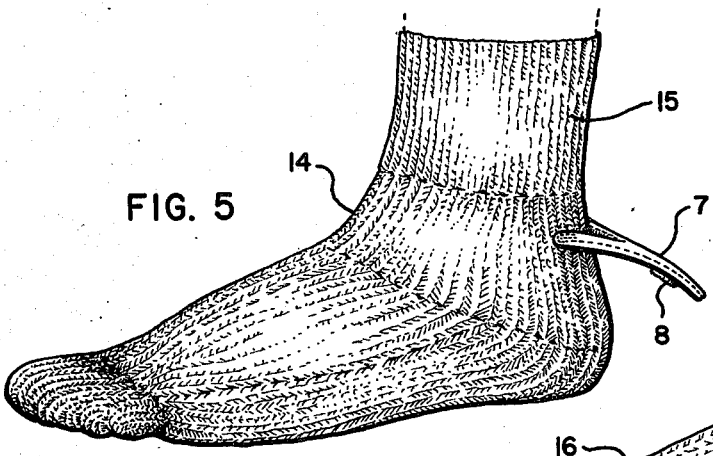
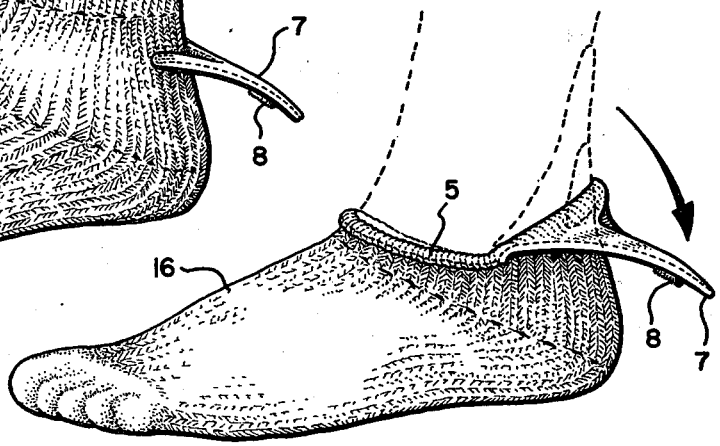
FIG. 6

SOCK AND SHOE AND SOCK AND SHOE FASTENING MEANS

The present invention relates to a sock that is worn on a person's foot, to a sock and shoe combination as worn together by a person, and to a shoe having a means for fastening the sock to the shoe. More specifically, the present invention relates to a sock having a flap protruding from its rear or heel area, which flap can be fastened to the outside of the rear or heel area of a shoe to prevent the sock from riding, slipping or otherwise working into the heel cavity of the shoe as the person wearing the sock and shoe moves about.

BACKGROUND OF THE PRIOR ART

Sports participants and particularly track and field participants often participate without gym socks on their feet for the reasons that gym socks, particularly those having tubes that extend above the ankle of the wearer, add weight to the participant, particularly as perspiration is absorbed by the sock, and retain body heat. Added weight and heat retention are especially disadvantageous for long-distance runners. Oftentimes, the decision not to wear gym socks is dictated by these reasons rather than by comfort, since wearing athletic shoes without socks is not particularly comfortable to the wearer.

An alternative to tube socks is tubeless socks of short-length, which generally are cut below the ankle of the wearer. These socks decrease weight and heat retention, and they are also stylish, especially for female participants in sports such as golf and tennis, in which the participant generally prefers not to wear socks having tubes extending above the ankles. However, the use of these short-length socks is less than desirable in many instances because they tend to ride or slide into the heel cavity of the athletic shoe as the wearer walks or runs. This results in discomfort and defeats the purpose of the sock. Tube or standard-length socks also tend to ride into the heel cavity of the shoe. Consequently, some wearers will not wear even standard-length socks.

Some attempts have been made to prevent or minimize the extent of riding, sliding, or working of the heel portion of a short-length sock into the heel cavity of a shoe. Some socks primarily designed for female wearers contain tassels extending from the top of the heel of the sock (the collar or opening). These tassels lay over the back of the athletic shoe and are intended to provide some resistance to the riding or sliding down of the heel of the sock into the shoe. However, because these tassels are not immovably affixed to the outside of the heel area of the shoe, the sock still tends to ride into the shoe. In fact, this riding action can occur with sufficient force to break the tassels and to continue with no resistance whatsoever. Another attempt has been to fold an extension of the top or collar of a short-length sock down over the top of a shoe. Still another attempt has been to provide an elastic neck at or near the collar of the sock to attempt to prevent slippage. These attempts also suffer from the deficiency that although some resistance to slippage may occur, slippage is not totally prevented. Furthermore, these attempts have not always worked satisfactorily.

The present invention solves the above-described problem by allowing a person to wear a sock which will not ride or slide into the shoe of the wearer. The sock of the present invention contains a flap which protrudes from the rear of the sock at or above the heel region and which can be fastened to the outside of the rear or heel region of a shoe. This flap, when fastened, completely restrains riding or sliding of the sock into the shoe.

SUMMARY OF THE INVENTION

The present invention is a sock comprising a toe region, a heel region, optionally a tube, a collar defining an opening, and a flap protruding from the rear of the sock at or above the heel region for fastening to the outside of the rear or heel region of a shoe to prevent the sock from sliding or riding into the shoe. The present invention also includes a sock and shoe combination, wherein the sock is attached to the shoe by the flap, and a shoe having a fastening means affixed to the outside of its rear or heel region for fastening the flap of the sock.

BRIEF DESCRIPTION OF DRAWINGS

FIG. 1 is a side elevational view of a sock of the present invention showing a flap protruding from the collar of the heel region, a portion of the leg of a wearer being shown in dotted lines.

FIG. 2 is a bottom plan view of the sock showing the flap fastening means.

FIG. 3 is a side elevational view showing the sock and shoe combination of the present invention with the sock fastened to the shoe by a flap.

FIG. 4 is an end elevational view of the sock and shoe combination of the present invention.

FIG. 5 is a side elevational view of a second form of a sock of the present invention.

FIG. 6 is a side elevational view of a third form of a sock of the present invention showing the flap as an integral extension of the collar of the sock.

DETAILED DESCRIPTION OF THE INVENTION

As shown in FIG. 1, the sock 1 of the present invention comprises a toe region 2, an arch region 3 (which hereafter will be referred to and included as part of the toe region 2), a heel region 4, a collar 5 defining a neck or an opening 6 (occupied by the leg of the wearer as shown in dotted lines) and a flap 7, which protrudes from the rear of the sock at or above the heel region as shown. A fastening means 8 preferably is affixed to the flap 7, preferably to its underside, as shown in FIG. 2.

The sock 1, and specifically the flap 7 of the sock, is detachably fastened to a shoe 10 as shown in FIG. 3. The flap fastening means 8 is designed to engage a shoe fastening means 12, which preferably is affixed to the outside rear or heel region 11 of the shoe 10 as shown in FIG. 3. However, the flap 7 may be attached to the shoe by any available means. The two fastening means 8 and 12 are fastened together by first placing the flap 7 over the heel top 13 of of the shoe and down its back such that fastening means 8 is opposite fastening means 12 and then pressing or connecting the two means together. See FIG. 3. The flap 7 preferably contains an aperture 9 (FIG. 2), which is designed to fit around the horn or heel top 13 of the shoe, which top on athletic or gym shoes generally is pointed as shown.

When the flap 7 of the sock 1 is fastened to the shoe 10 as shown in FIG. 3, the sock will not ride or slide into the heel cavity of the shoe when the sock and shoe are worn together. This is because the flap 7 continually holds the heel region 4 of the sock stationary and immovable with respect to the heel region 11 or top 13 of the shoe, by providing a continuous tension on the heel region 4 of the sock at the point of attachment of the flap 7 to the sock. Thus continuous movement by a wearer will not work the heel of the sock into the heel cavity of the shoe as is experienced when a sock is not immovably fastened to a shoe.

Preferably the flap 7 is Y-shaped as shown in the figures, although many different configurations are possible, such as square, rectangular, circular, etc. The flap should be flexible so that it can be fitted over the heel top 13 of a shoe and down the back of the shoe. If the heel top 13 or horn is pointed as shown, then an aperture 9 in the flap, through which the horn may protrude, will allow the flap to be pulled more easily over the heel top and down the back of the shoe. The flap preferably is made of cloth or other fabric although any other relatively flexible material can be used.

Although the flap can be a separate piece of material that is sewn or attached to the heel region of a sock, it also can be an extension of the sock such as from the top or collar 5 of the sock 16, as shown in FIG. 6. This collar extension can be of any workable configuration. Such extension allows for unitary sock construction.

As mentioned, the flap preferably is attached at or above the heel region of the sock. Preferably, the attachment would be at the collar 5 of a tubeless or short-length sock. However, the invention also is applicable to a standard tube sock 14 as shown in FIG. 5. This sock 14 has a tube 15 that extends above flap 7.

The sock fastening means 8 preferably is a Velcro fastener. One part of the fastener is affixed preferably to the underside of the flap 7, and the other part is affixed to the outside rear or heel region of a shoe (FIG. 4). A Velcro fastener is wellknown to the public and is used for various fastening applications. It comprises synthetic materials that adhere when pressed together. More specifically, a Velcro fastener comprises opposing patches attached to opposing parts of an article(s) (in the present instance, a sock flap and a shoe). One patch contains numerous small loops (similar to terry loops), and the other patch contains short, stiff, curved bristles that engage the loops and cause the patches to adhere when the patches are pressed together. This type of fastener is especially effective in restraining horizontal movement of the patches relative to each other. Moreover, an elongated patch on either the flap or the shoe will allow for variable positioning of the opposing patch and thereby for variable adjustment of the point of attachment of the flap with respect to the rear heel of the shoe.

Other fastening means can be used and are wellknown, such as a snap fastener, which comprises a ball part that engages a socket part, a hook-and-eye fastener, pins, and adhesives. Regardless of the particular fastening means employed, it should prevent movement of the flap 7 relative to the shoe and thereby restrain movement of the sock.

The fabric and configuration of the sock are immaterial. The invention will work with thin socks (such as nylon socks) as well as with thick, gym or sweat socks. The invention is particularly advantageous for use with short-length socks (i.e., socks that extend to or slightly above the level of the top of a regular, low-cut shoe) because such socks cause considerable discomfort when they slip or work into a shoe. The sock may have an enlarged, bulky or fluffy collar or none at all.

The type and configuration of the shoe similarly are immaterial. All shoes having a toe region, a rear or heel region and a heel cavity can be used. Although the present invention primarily is designed to be used with low-cut shoes, it is adaptable to hightop shoes or boots that usually are worn with tube socks. With high-top shoes or boots, the flap would be attached to or extend from the top or near the top of the tube of the sock at its collar. The shoe fastening means would be positioned somewhat above the heel region of the shoe.

While the present invention has been described with reference to certain illustrative and preferred embodiments, various modifications will be apparent to those skilled in the art and any such modifications are intended to be within the scope of the invention as set forth in the appended claims.

What is claimed is:

1. A sock for a foot comprising a toe region, a heel region, optionally a tube, a collar defining an opening, and a Y-shaped flap protruding from the rear of the sock at or above the heel region for fastening to the outside of the rear or heel region of a shoe to prevent the sock from sliding or riding into the shoe, the upper two legs of the flap being joined to the sock and the lower single leg being free for fastening to the shoe.

2. A sock according to claim 1 wherein the flap contains a fastening means for fastening the flap to the shoe.

3. A sock according to claim 1 wherein the sock is shortlength and reaches only to or below the ankle of a wearer.

4. A sock according to claim 2 wherein the fastening means includes one portion of a fastener constructed of synthetic resin the other portion of which may be affixed to the outside of the rear or heel region of a shoe, one fastener portion being provided with a plurality of outwardly facing relatively stiff, flexible, pile hooks and the other fastener portion being provided with a plurality of outwardly facing flexible pile loops.

5. A sock according to claim 2 wherein the fastening means is an adhesive attached to either the flap or shoe or both.

6. A sock according to claim 1 wherein the flap is made of cloth or fabric which is affixed to the sock.

7. A sock according to claim 1 wherein the flap is an extension of the collar or tube of the sock itself.

8. A shoe for a foot having a fastening means affixed to its outside rear or heel region for fastening the flap of the sock described in claim 1.

9. A shoe according to claim 8 wherein the fastening means includes one portion of a fastener constructed of synthetic resin, the other portion of which is affixed to the flap of the sock, one fastener portion being provided with a plurality of outwardly facing relatively stiff, flexible, pile hooks and the other fastener portion being provided with a plurality of outwardly facing flexible pile loops.

10. A sock and shoe combination for a person's foot comprising a shoe having a toe region and a rear or heel region that defines a heel cavity and a sock worn within the shoe which sock comprises a toe region, a heel region, optionally a tube, a collar defining an opening, and a flap protruding from the sock at or above the heel region and including a fastening means for attachment to the outside rear or heel region of the shoe to prevent the sock from riding or sliding into the heel cavity of the shoe.

11. A combination according to claim 10 wherein the flap of the sock and the outside rear or heel region of the shoe each contain a fastening means which fasten together.

12. A combination according to claim 10 wherein the sock is short-length and reaches only to or below the ankle of a wearer.

13. A combination according to claim 11 wherein the sock and shoe fastening means comprise a synthetic resin hook and loop fastener.

14. A combination according to claim 11 wherein the sock and shoe fastening means comprise adhesives.

15. A combination according to claim 10 wherein the flap of the sock is an extension of the collar or tube of the sock itself.

16. A shoe for a foot, which shoe comprises a toe region, a rear or heel region, and a fastening means affixed to the outside of the rear or heel region for purposes of fastening to a flap protruding from the rear or heel region of a sock, which is worn within the shoe, thereby to prevent the sock from riding or sliding into the shoe.

17. A shoe according to claim 16 wherein the fastening means is one-half of a synthetic resin hook and loop fastener, the other half of which is affixed to the flap of the sock.

* * * * *